US005715619A

United States Patent [19]

Polisois et al.

[11] Patent Number: 5,715,619

[45] Date of Patent: Feb. 10, 1998

[54] INFORMATION DISPLAY SIGN

[75] Inventors: Alexandre Polisois; Daniel Chevalier, both of Boisbriand, Canada

[73] Assignee: Groupe Infocite Inc., Laval, Canada

[21] Appl. No.: 683,317

[22] Filed: Jul. 18, 1996

Related U.S. Application Data

[63] Continuation-in-part of Ser. No. 399,884, Mar. 7, 1995, abandoned.

[51] Int. Cl.[6] ..... G09F 3/04

[52] U.S. Cl. ..... 40/452; 40/581; 362/248; 362/294; 362/359; 362/800

[58] Field of Search ..... 40/452, 550, 559, 40/581, 551; 362/248, 294, 359, 800

[56] References Cited

U.S. PATENT DOCUMENTS

| | | | |
|---|---|---|---|
| 3,573,452 | 4/1971 | Kenyon et al. | 362/294 |
| 5,036,248 | 7/1991 | McEwan et al. | 362/800 X |
| 5,268,828 | 12/1993 | Miura | 362/800 X |
| 5,313,729 | 5/1994 | Sakai et al. | 40/452 |
| 5,321,417 | 6/1994 | Voelzke et al. | 362/800 X |
| 5,400,228 | 3/1995 | Kao | 362/800 X |

*Primary Examiner*—Brian K. Green

*Attorney, Agent, or Firm*—Cushman Darby & Cushman Intellectual Property Group of Pillsbury Madison & Sutro LLP

[57] ABSTRACT

The disclosure herein describes an information displaying traffic sign which comprises a board, the front side of which is formed of dusters of LED devices. Visors are mounted to the front of the board, each visor being provided with an opening on its top face so that vertical air circulation along the front side of the board may be permitted to cool the LED devices. Shades are provided, adjacent to each visor opening, to prevent sun rays from reaching the LED devices.

8 Claims, 3 Drawing Sheets

44
46
41
26
34
6
40
30
24
35
31
36
33
42
26
6

42
30
34
26
31
32
33

47
46
48
49
34
36
24
22
37
32
31
33

INFORMATION DISPLAY SIGN

This is a Continuation-in-Part National of: Appln. No. 08/399/884 filed Mar. 7, 1995, now abandoned.

FIELD OF THE INVENTION

The present invention relates to an information display sign and, more particularly, to a traffic information board which displays numerals, text, graphics and/or pictograms to road users.

BACKGROUND OF THE INVENTION

Variable message sign boards are used more and more as an effective way of reducing congestion and pollution from traffic in addition to improving road safety.

There are various types of variable message sign boards, such as incandescent displays, electromechanical light reflecting displays, liquid crystal displays and light emitting diode displays.

Light emitting diodes (LEDs) are increasingly popular in highways because of their high reliability and low power consumption. Because LEDs are solid state devices, no mechanically moving parts are used in these boards, which results in a reduction in the cost of maintenance and in the servicing problems which are usually encountered in other types of boards.

Also, LEDs are able to emit a number of single colours, including yellow, orange, green and red, which are, however, difficult to read in bright sunlight; indeed, boards employing LEDs tend to wash out in bright sunlight. The consequent density for the required brightness can make them a costly solution.

Sign enclosures are designed to meet stringent requirements in order to protect the electronics including the displays. These enclosures incorporate heaters or cooling fans in order to maintain circuitry within an optimal temperature range in addition to front baffles and fans to reduce internal condensation and fogging of the front window of the enclosure.

Early attempts to use LEDs in traffic signs have proven to be unsatisfactory as a result of failure associated with indoor products being applied to outdoor environments. On the other hand, there are advantages in using LEDs to replace incandescent lamps, one of which is energy savings. Also, as life expectancy of LEDs in a traffic signal application is about ten years, maintenance for routine replacement of incandescent lamps is substantially reduced.

OBJECTS AND STATEMENT OF THE INVENTION

It is an object of the present invention to overcome the problems associated with boards presently equipped with LED devices. This is achieved by providing the LED devices with sun visors which have openings allowing air circulation very close to the LED face. Furthermore, shades are provided on the visors to prevent sun rays from entering these cooling openings and impinging onto the LED faces.

The present invention therefore relates to an information displaying sign which comprises:

a board having a front side;

clusters of actuatable LED devices mounted to the front side and arranged in columns and rows;

a LED protecting cap extending frontwardly of the front side of the board for each cluster of LED devices; the protecting cap defining a body including:

(i) an inner part defining a cavity enclosing the cluster, the cavity being formed of a base, opposite sides converging to a dome-shaped top wall;

(ii) a frontwardly extending part formed of opposite vertical side walls integral with the opposite sides of the inner part and converging upwardly to an obliquely-truncated cylindrical top surface; the top surface displaying a rectangular opening adjacent the dome-shaped top wall and extending from one side wall to an opposite side wall; the rectangular openings of a column of clusters being aligned so as to define an unobstructed vertical air passage therethrough to cool the LED devices; the opposite side walls of the inner part protecting the LED devices from side light incidence thereon; and shade means extending vertically from the top surface at the frontmost side of each rectangular opening, the shade means being adjacently disposed in horizontal alignment to prevent sunlight impairement and UV radiation from falling onto the LED devices through the openings.

The present invention also pertains to a traffic display sign wherein the above described components are contained in an enclosure.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
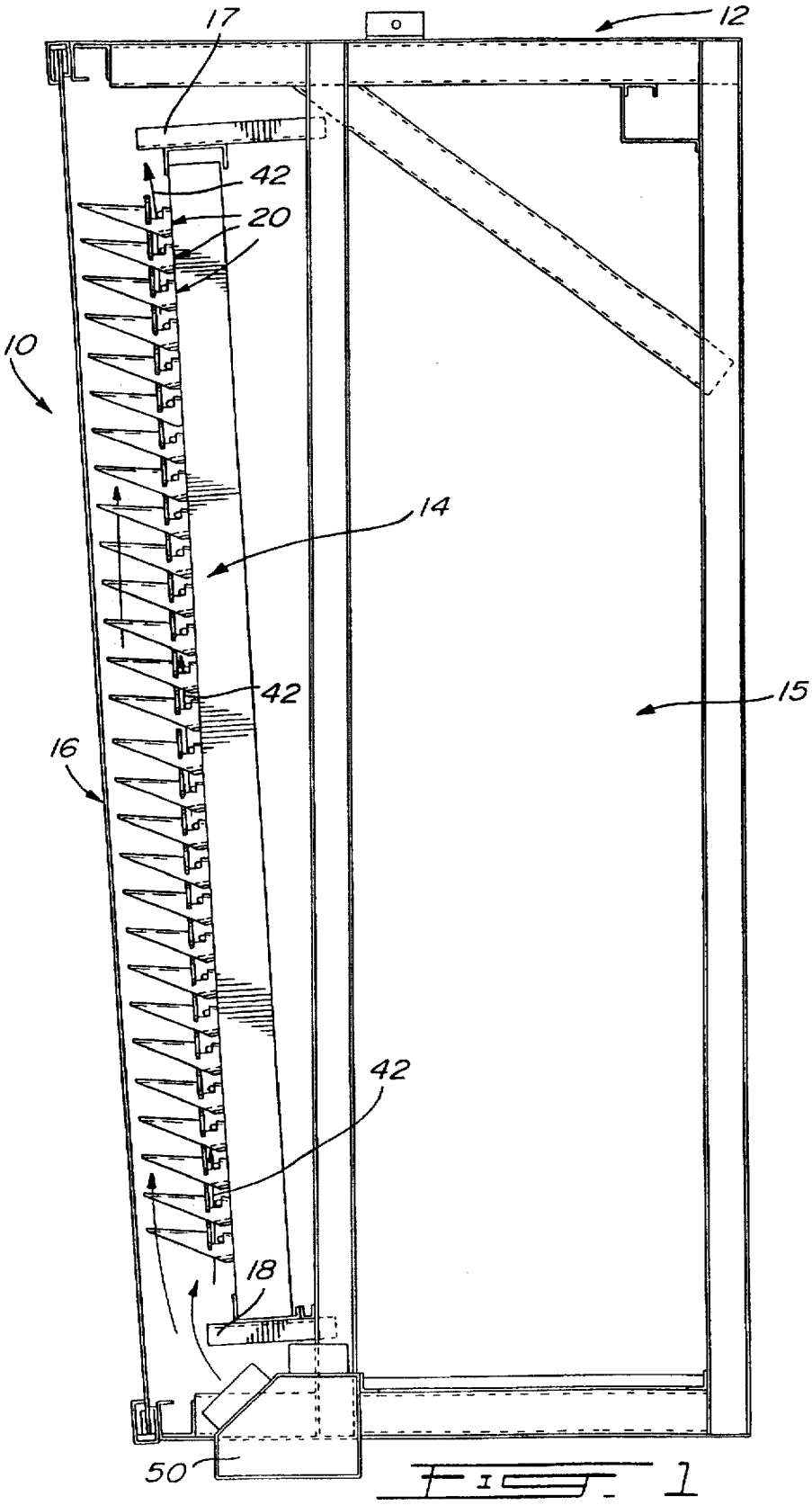
FIG. 1 a schematic side elevation of an information display sign made in accordance with the present invention.

Referring to FIG. 1, there is shown an information display sign, generally denoted 10, which comprises a frame structure, generally denoted 12, for supporting a panel 14 made in accordance with the present invention.

Figure 2:
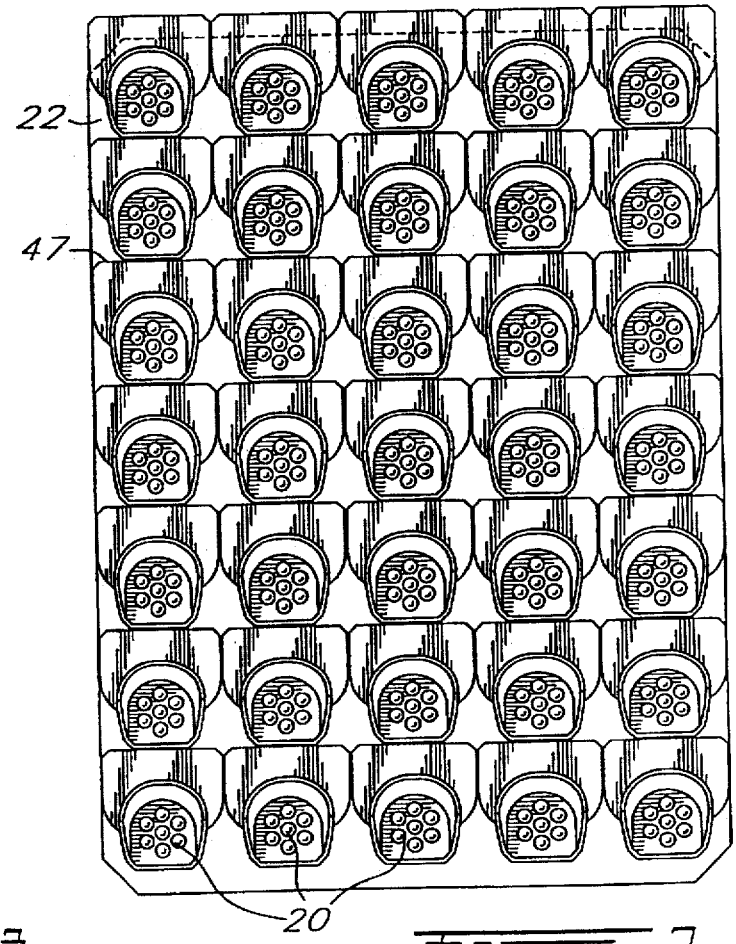
FIG. 2 is a front view of part of the sign shown in FIG. 1.

Often, the supporting structure 12 defines an enclosure which is sufficiently large to enable an operator to work behind the panel 14 in an area 15. A transparent window 16 usually extends in front of the panel 14 to protect the board. Schematically represented in FIG. 1, the panel 14 is supported in the enclosure by means of top and bottom structural members 17 and 18. The panel 14 is usually rectangular and displays, on its front side, clusters of LED devices, generally denoted 20, arranged in rows and columns as seen in FIG. 2.

Figure 4:
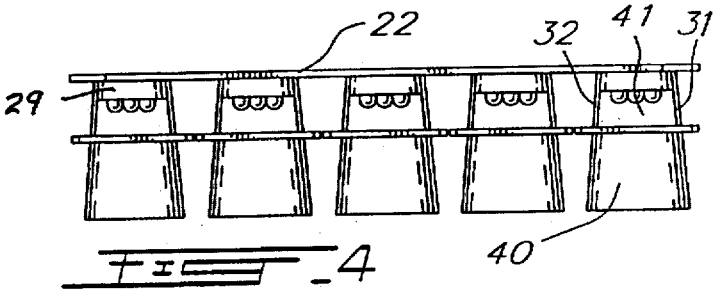
FIG. 4 is a top view of FIG. 2.
Figure 3:
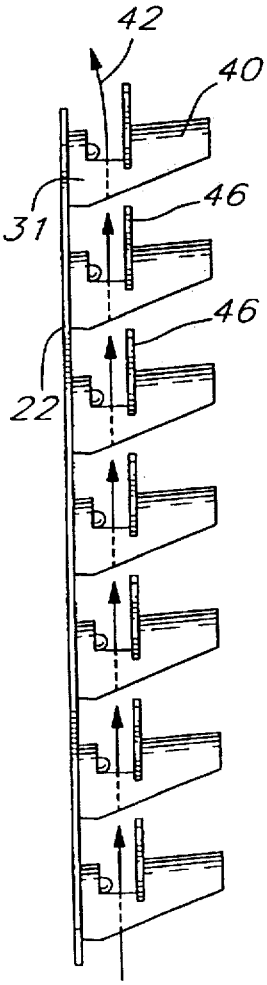
FIG. 3 is a side view of FIG. 2.

Referring also to FIGS. 3 and 4, each cluster of LED devices 20 is mounted to a wall or board 22. Electrical circuitry is provided behind the wall to activate the diodes in the well known conventional way; alternatively, the wall may form a printed circuit board which includes all the electronic circuitry required for the operation of the diodes 26.

Figure 5:
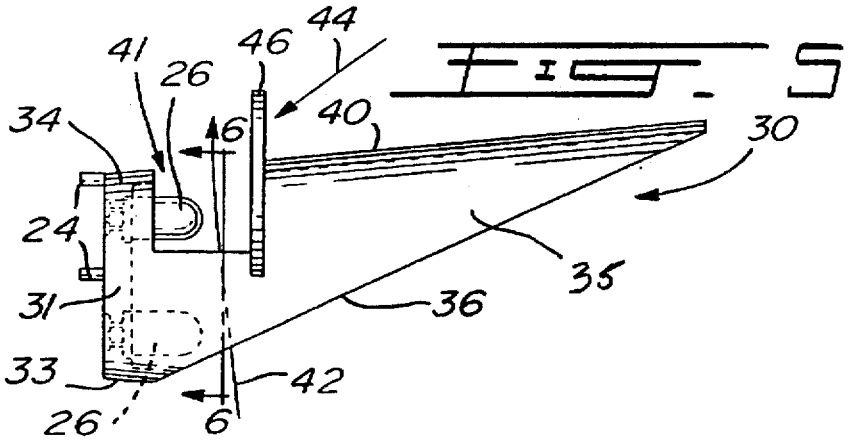
FIG. 5 is a side elevational view of a visor.
Figure 6:
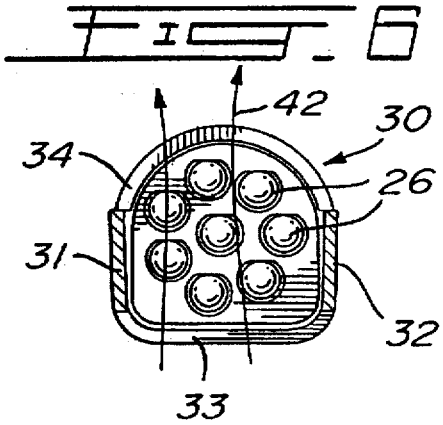
FIG. 6 is a view taken along lines 6—6 of FIG. 5.
Figure 7:
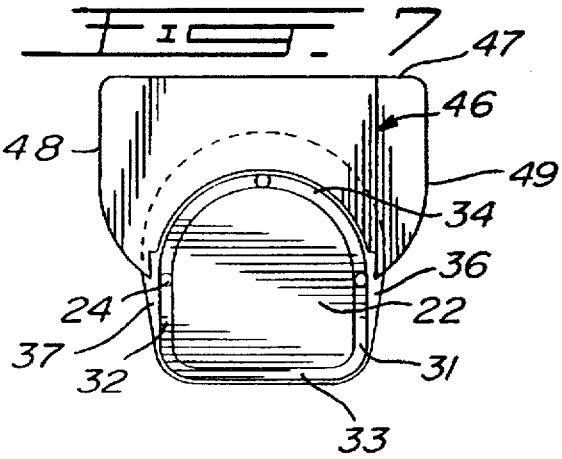
FIG. 7 is a rear view as seen from the left of FIG. 5.

To prevent the sun rays from reaching the illuminated face of each LED lamp, a visor 30 is provided for each cluster of LED devices. The visor is mounted to the board 22 by one or more pins 24. The visor has the shape of a cylindrical cap with a lower truncated side. Referring to FIGS. 5, 6 and 7, the sun visor 30 has an inner part defining a cavity formed of opposite side walls 31 and 32, a base 33 and a dome-shaped upper portion 34. This cavity serves as a form for retaining liquid silicone 29 used to protect the LED cluster from moisture until it hardens during the course of manufacturing. The sun visor also includes a frontwardly projecting part 35 that is formed of opposite side walls 36 and 37 integral with the corresponding sides 31 and 32 of the inner part and converging upwardly to an obliquely truncated top surface 40.

Since light emitting diodes generate heat, most display signs include an air inlet 50 (see FIG. 1 ) at its lower part allowing air to move upwardly between the panel 14 and the front window 16 and exit above. The air circulation is natural or it may be forced, either vertically or horizontally, in which case air forcing means (not shown) may be provided.

As the visors greatly affect the cooling action of the air circulating upwardly, the present invention provides the sun visors 30 with an opening 41 in its top face 40 to thereby allow the air to circulate very near and around the surface of each light emitting diode 26, such as illustrated by arrows 42 in FIGS. 5 and 6. As can be seen in FIG. 4, the opening 41 has a rectangular shape spanning over the rounded top surface of the visor. As can be seen in FIG. 3, the rectangular opening extends also to the sides 31 and 32 so that cooling of the diodes may be effected horizontally from each opposite side of the visor, in which case air circulation from side to side of the panel would be forced.

In order to prevent the sun rays, as indicated by arrow 44 in FIG. 5, from penetrating the opening 41 and impinging on the light emitting diodes, a vertical shade 46 is provided at the outermost edge of the opening 41.

Referring to FIG. 7, this shade has a rectangular shaped upper area defined by an upper edge 47 and two opposite sides edges 48 and 49. The side edges are very close to the side edges of adjacent caps to prevent sun rays from reaching the lamps sideways. Similarly, the upper edges 47 are near the bottom 33 of the inner part of a superposed cap again. It is to be noted that various shapes may be given to the shades as long as they block sun rays to the diodes. Also, the sides 36 and 37 will block sunlight arriving at an angle to the side of the LED devices.

Although the invention has been described above in relation to a number of specific forms, it will be evident to the person skilled in the art that it may be modified and refined in various ways. It is therefore wished to have it understood that the present invention should not be limited in interpretation, except by the terms of the following claims.

The embodiments of the invention in which an exclusive property or privilege is claimed are defined as follows:

1. An information display sign comprising:

a board having a front side;

clusters of actuatable LED devices mounted on said front side and arranged in columns and rows;

a LED protecting cap extending substantially perpendicularly from said front side of said board for each said cluster of LED devices; said protecting cap defining a body including:

(i) an inner part defining a cavity at least partially enclosing said cluster, said cavity being formed of a base, opposite sides converging to define a dome-shaped top wall;

(ii) an extending part formed of opposite side walls integral with said opposite sides of said inner part and converging to define a curved top surface and including lower edges on opposite sides of said top surface which are obliquely-truncated; said top surface including a rectangular opening in a portion of said dome-shaped top wall and extending from one side to an opposite side and having a frontmost side; the rectangular openings of a column of clusters being aligned so as to define an unobstructed air passage therethrough to cool said LED devices; said opposite sides of said inner part protecting said LED devices from side light incidence thereon; and shade means comprising a wall extending from said top surface at the frontmost side of each said rectangular opening, each said shade means being disposed in alignment with one another to prevent sunlight impairment and UV radiation from falling onto the LED devices through said openings.

2. An information display sign as defined in claim 1, wherein each said shade means has a rectangular-shaped upper area over said top surface.

3. An information display sign as defined in claim 2, wherein said upper areas of said caps in a horizontal row are in alignment so that cooling air horizontally forced onto said sign is unobstructed as it travels horizontally over said LED devices.

4. An information display as defined in claim 1, wherein said cavity includes hardened silicone for protecting the LED devices from moisture.

5. An information display traffic sign comprising:

an enclosure having a top, a bottom and a transparent front panel;

air entrance means at said bottom of said enclosure allowing air to circulate in said enclosure from bottom to top;

a board having a front side;

clusters of LED devices mounted on said front side and arranged in columns and rows;

a LED protecting cap extending generally perpendicularly of said front side of said board for each cluster of LED devices; said protecting cap defining a body including:

(i) an inner part defining a cavity enclosing said cluster, said cavity being formed of a base, opposite sides converging to a dome-shaped top wall;

(ii) a frontwardly extending part formed of opposite vertical side walls integral with said opposite sides of said inner part and converging upwardly to an obliquely-truncated cylindrical top surface; said top surface including a rectangular opening adjacent said dome-shaped top wall and extending from one side to an opposite side and including a frontmost side; the rectangular openings of a column of clusters being aligned so as to define an unobstructed vertical air passage therethrough to cool said LED devices; the opposite sides of said inner part protecting said LED devices from side light incidence thereon; and shade means comprising a wall extending vertically from said top surface at the frontmost side of each said rectangular opening, said shade means being disposed in horizontal alignment with one another to prevent sunlight impairment and UV radiation from falling onto the LED devices through said openings.

6. An information display sign as defined in claim 5, wherein each said shade means has a rectangular shaped upper area over said top surface.

7. An information display sign as defined in claim 6, wherein said upper areas of said caps in a horizontal row are in alignment so that cooling air horizontally forced onto said sign is unobstructed as it travels horizontally over said LED devices.

8. An information display sign as defined in claim 5, wherein said cavity includes hardened silicone for protecting the LED devices from moisture.

* * * * *